US006309060B1

(12) United States Patent
Timmermans-Wang et al.

(10) Patent No.: US 6,309,060 B1
(45) Date of Patent: Oct. 30, 2001

(54) INKJET PRINTING DEVICE, A METHOD OF APPLYING HOTMELT INK, IMAGE-WISE TO A RECEIVING MATERIAL AND A HOTMELT INK SUITABLE FOR USE IN SUCH A DEVICE AND METHOD

(75) Inventors: Mei-fen Timmermans-Wang, Broekhuizervorst; Thomas Petrus Huijgen, Eindhoven; Rudolf Antonius Hendricus Marie Sturme, Maasbree, all of (NL)

(73) Assignee: Oce-Technologies B.V., Ma Venlo (NL)

( * ) Notice: Subject to any disclaimer, the term of this patent is extended or adjusted under 35 U.S.C. 154(b) by 0 days.

(21) Appl. No.: 09/266,944

(22) Filed: Mar. 12, 1999

(30) Foreign Application Priority Data

Mar. 12, 1998 (NL) ..... 1008572

(51) Int. Cl.[7] ..... B41J 2/175; B41J 2/01
(52) U.S. Cl. ..... 347/88; 347/102
(58) Field of Search ..... 347/88, 99, 102

(56) References Cited

U.S. PATENT DOCUMENTS

| | | | | |
|---|---|---|---|---|
| 2,849,752 | | 9/1958 | Leary . | |
| 3,655,379 | * | 4/1972 | Guanlach | 250/315.5 |
| 4,202,618 | | 5/1980 | Waschk et al. | 399/93 |
| 4,239,544 | * | 12/1980 | Strem | 106/22 |
| 4,853,706 | | 8/1989 | Van Brimer et al. | 347/102 |
| 4,971,408 | * | 11/1990 | Hoisington et al. | 347/102 |
| 5,023,111 | | 6/1991 | Fulton et al. | 427/164 |
| 5,043,741 | | 8/1991 | Spehrley | 347/88 |
| 5,621,448 | * | 4/1997 | Oelbrandt et al. | 347/96 |

FOREIGN PATENT DOCUMENTS

| | | |
|---|---|---|
| 04 080039A | 3/1992 | (JP) . |
| 07 013008A | 1/1995 | (JP) . |

* cited by examiner

*Primary Examiner*—N. Le
*Assistant Examiner*—Shih-Wen Hsieh
(74) *Attorney, Agent, or Firm*—Birch, Stewart, Kolasch & Birch, LLP

(57) ABSTRACT

An inkjet printing device for applying hotmelt ink, image-wise, to a receiving material, wherein the inkjet printing device contains a radiation device for irradiating the receiving material provided with the hotmelt ink with radiation energy for a short time such that the hotmelt ink at least partly penetrates into the receiving material without visible feathering occurring.

The radiation device can be a gas discharge lamp which irradiates for a time between 1 and 1000 $\mu$s with radiation primarily in the visible wavelength range. The present invention also contemplates hotmelt inks provided with infrared-absorbent substances.

1 Claim, 6 Drawing Sheets

INKJET PRINTING DEVICE, A METHOD OF APPLYING HOTMELT INK, IMAGE-WISE TO A RECEIVING MATERIAL AND A HOTMELT INK SUITABLE FOR USE IN SUCH A DEVICE AND METHOD

BACKGROUND OF THE INVENTION

The present invention relates to an inkjet printing device comprising means for the image-wise application of hotmelt ink to a receiving material.

The present invention also relates to a hotmelt ink and a combination of hotmelt inks suitable for use in such an inkjet printing device.

The present invention further relates to a method of forming an image of hotmelt ink on a receiving material, wherein drops of liquid hotmelt ink are sprayed by an inkjet printhead onto a receiving material in accordance with electrical image signals fed to the inkjet printhead, and heating the hotmelt ink applied to the receiving material.

Hotmelt inks do not contain solvents to keep them in the liquid state such as are provided in water-soluble inks. Hotmelt inks are solid at room temperature and are not made liquid by heating until just before application to the receiving material. Once applied to the receiving material, the hotmelt ink sets again. U.S. Pat. No. 5,043,741 describes the problems which may occur in these conditions. If the temperature of the receiving material is too low, the ink sets too rapidly and hence too much remains on the surface of the receiving material. As a result, in addition to reduced print quality due to inadequate coverage, the adhesion to the receiving material is less satisfactory. If, on the other hand, the temperature of the receiving material is too high, the ink sets too late, so that it penetrates deeply into the receiving material, in which conditions the ink may even reach the back of the receiving material. Excessive penetration of the ink into the receiving material can lead to inadequate optical density as a result of dilution or the ink no longer being visible on the surface. In addition, too long a heating may result in undefined flowing out of the ink. In this case the fiber structure of the receiving material in particular plays a part. The ink then flows out along the locally present fibers so that an irregular form is obtained. This effect is known as "feathering".

Known devices therefore try to keep the temperature of the receiving material constant by keeping the temperature of a guide surface for the receiving material constant. In that case, however, no consideration is given to the differences in the properties of different receiving materials or the time that they remain in contact with such a guide surface. The device according to the said patent is therefore suitable for rapidly controlling the temperature of such a guide surface. For this purpose, the guide surface is continuously in heat contact with both heating means of the conventional electrical resistance heating type and cooling means of the thermoelectric type. The whole is accommodated in a practically closed housing with defined inflow and outflow air openings. The associated temperature control ensures that temperature of the guide surface for the receiving material remains between 25° C. below and 25° C. above that of the ink melting temperature.

One disadvantage of such a system, apart from the complexity of the temperature control, is that although the properties of the receiving material have less influence, they are still present. The heat regulation obtained as a result is not optimum so that the problem of feathering is not really prevented. In practice, feathering can still occur.

U.S. Pat. No. 5,023,111 also describes a hotmelt printing device. Here, the ink applied to the receiving material is kept above the melting temperature for some time. For this purpose, the receiving material is also guided over a heated guide surface. The latter is curved at the beginning and end in the direction of transport of the receiving material in order to counteract any curvature of the receiving material. At the end of the transport path, along the heated guide surface, a rapid temperature drop is obtained by the fact that part of the guide surface is in heat contact communication with a cooling body, locally.

The disadvantage of this is again the complex construction required, in which it is only the distortion of the receiving material that is counteracted. Adequate measures for preventing excessive or inadequate flowing out are not described. Here again feathering can still occur.

U.S. Pat. No. 4,971,408 also refers to distortion of the receiving material during application of hotmelt ink. This is attributed inter alia to moisture being withdrawn from the receiving material in the case of heating uncontrollably. Mention is also made of the problem of keeping the guide surface for the receiving material at a constant temperature. In accordance with the hotmelt printing device described in U.S. Pat. No. 4,971,408, the temperature of the receiving material is kept below the melting temperature of the ink during the ink application, whereafter the ink present on the receiving material is again heated, in controlled manner, for a period of between 0.5 and 10 seconds, to above the melting temperature in a separate re-heating device. Preferably, a heat radiator is used for the re-heating. The disadvantages of the heated guide plate are admittedly not present, but the relatively long time during which the receiving material with the ink has to be heated may result in unwanted heating of the receiving material and ink and hence again cause feathering of the hotmelt ink.

U.S. Pat. No. 4,202,618 describes a copying machine in which fixing is also effected by means of short radiation pulses originating from a flash lamp. However, this relates to an electrophotographic process wherein the inks used are of a completely different type. In an electrophotographic process a charged photo conductor is exposed image-wise whereafter non-heated toner of thermoplastic material mixed with carbon is applied to the resulting charge image. This toner image is then electrostatically transferred to receiving material. The toner on the receiving material is then exposed to short radiation pulses originating from a flash lamp. However, toner of this kind has a completely different flow behaviour. On heating, it does not become completely liquid like hotmelt ink, but only plastic. An absorption of such toner in the receiving material as in the case of hotmelt ink cannot therefore occur.

SUMMARY OF THE INVENTION

In contrast, the inkjet printing device according to the present invention obviates the above problems and is characterized in that the inkjet printing device contains radiation means for irradiating the receiving material provided with hotmelt ink, with radiation having an energy such and for a short time such that the hotmelt ink at least partly penetrates into the receiving material without visible feathering occurring.

By irradiating for a short period, energy can be supplied to the hotmelt ink in an accurately metered and controlled manner so that feathering can be obviated. As a result of the short irradiation time, the ink does not have sufficient opportunity to flow out uncontrollably.

One advantageous embodiment of the present invention is characterized in that the short time comprises at least a continuous time interval of 0.5 seconds at a maximum.

Another advantageous embodiment of the present invention is characterized in that the at least one continuous time interval has a value of between 1 and 1000 $\mu$s.

One advantageous embodiment for obtaining such short time intervals is characterized in that the radiation means comprise a gas discharge lamp. In this way, the time intervals can be achieved in a simple manner with adequate energy being emitted during the time intervals. Another advantage of a gas discharge lamp is that varying the operating voltage applied to the gas discharge lamp, and hence the current density, enables a different distribution to be selected for the radiation energy over the visible wavelength range compared with the near infrared range. The current density is the decisive factor for the spectral distribution.

Another advantageous embodiment of the present invention is that the maximum energy content of the radiation is in the wavelength range from 400 to 1700 nm. By irradiating primarily in the visible wavelength range, relatively more energy is absorbed by the darker colored hotmelt ink than by the receiving material which, in practice, is of a lighter color. This avoids any unnecessary and unwanted heating of the receiving material while sufficient energy can be absorbed by the hotmelt ink in order to allow it to flow out controllably. This is in comparison with radiators having the maximum energy in the infrared wavelength range in which relatively more energy absorption occurs in the receiving material. Also, in combination with the short period of irradiation, excessive energy absorption in the ink and the receiving material is also avoided. The combination of a short irradiation time with radiation in the visible light range enables metered energy absorption.

With regard to the quantity of energy absorbed in the said time interval, one advantageous embodiment is characterized in that the amount of radiation energy falling on the receiving material in the wavelength range of from 400 to 1700 nm is between 0.5 and 5 Joule/cm$^2$. In this case a certain quantity of energy absorption can also occur in the near infrared range.

Another advantageous embodiment is characterized in that the quantity of radiation energy falling on the receiving material in the wavelength range of from 400 nm to 700 nm is between 0.25 and 2 Joule/cm$^2$.

The fact that the maximum radiation energy can fall in the visible part of the wavelength range does not affect the fact that a favorable additional energy absorption can occur in the near infrared part of the wavelength range. For use in a hotmelt printing device as described above, an advantageous hotmelt ink according to the present invention is characterized in that they contain additional infrared-absorbent substances.

Another embodiment of such hotmelt ink is characterized in that the infrared absorbent substance is active, primarily in the wavelength range from 700 to 1700 nm.

A combination of hotmelt inks according to the present invention, w herein the combination contains at least two hotmelt inks for two different colors from the group of colors formed by C, M, Y or K, is characterized in that the quantity of infrared-absorbent substance of a first hotmelt ink for at least one first color differs from the quantity of infrared-absorbent substance of a second hotmelt ink for at least a second color. After the simultaneous heating of both the first and second hotment inks applied image-wise, to a receiving material, by means of the same radiation energy for the same short period of time, at least the first and second hotmelt inks penetrate equally at least partly into the receiving material without visible feathering occurring.

Since the hotmelt inks absorb the major part of the radiation energy in the visible part of the wavelength range, the energy absorption is therefore also dependent on the color of the hotmelt ink. This can advantageously be compensated for by adding, for each hotmelt ink for a specific color, a specific quantity of the infrared-absorbent substance for that color. In this way, using a single irradiation pulse, different hotmelt inks can flow out in the same way.

BRIEF DESCRIPTION OF THE DRAWINGS

The device and method according to the present invention will be explained in detail with reference to the accompanying drawings wherein, FIG. 1 diagrammatically illustrate s an inkjet printing device according to the prior art.

DETAILED DESCRIPTION OF THE INVENTION

Figure 1:
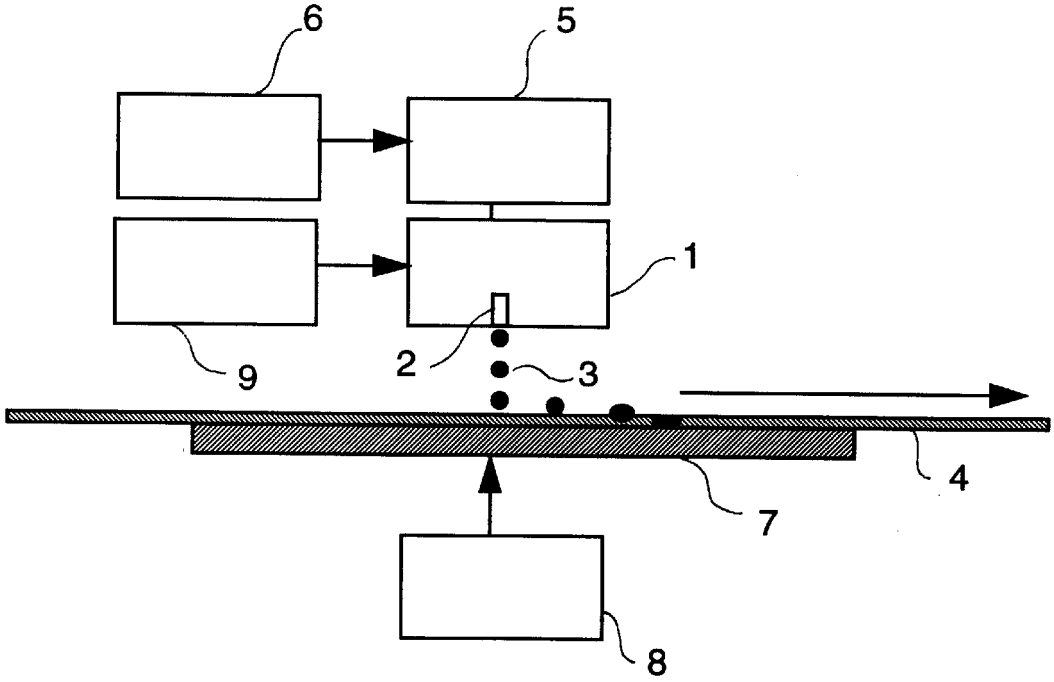

FIG. 1 shows a known inkjet printing device comprising an inkjet printhead 1 provided with a nozzle 2 for spraying hotmelt ink drops 3 on to receiving material 4. The latter, for example a sheet of paper, is advanced in the direction indicated along the inkjet printhead 1 by transport means (not shown in detail in the drawing). The inkjet printhead 1 is provided with hotmelt ink from a supply chamber 5. The hotmelt ink present therein is kept in a liquid state by first heating means 6. In one embodiment, the heating means 6 comprise one or more elements of the electrical resistance type in combination with a temperature control circuit. It must be remembered that a typical melting temperature for hotmelt ink is between 80 and 100° C. At room temperature the hotmelt ink is in a solid state, and above the melting temperature the hotmelt ink is practically as liquid as water. Thus at a temperature of 130° C. the characteristic viscosity of the hotmelt ink in the inkjet printhead 1 is 8 to 13 m Pa.s. The inkjet drops 3 are applied to the receiving material 4 image-wise by actuator means (not shown in detail) at the nozzle 2. Suitable actuator means may, for example, be of the piezo-electric type. With this type, a change of volume is produced in a duct communicating with the nozzle 3. This causes an ejection of a drop of hotmelt from the nozzle 3 to the receiving material 4. These actuator means are controlled by electrical image signals generated by an image generator 9. The image generator 9 may for this purpose either have available memory means where the information for forming these electrical image signals is stored, or be provided with connecting means for receiving the electrical image signals. The image signals can, in turn, originate from a network, scanner, or another external memory.

In practice, the hotmelt ink drops 3 applied in such manner to the receiving material 4 will set rapidly. Without further precautions, inadequate adhesion to the receiving material 4 is then obtained because the set hotmelt ink drop 3 does not penetrate adequately into the receiving material 4. In the case of using paper as the receiving material, the effect of this is inadequate penetration into the paper fibers.

For this purpose, a guide plate 7 is provided over which the receiving material 4 is guided. The guide plate 7 is kept at a temperature equal to or higher than the melting temperature of the hotmelt ink by suitable second heating means 8. Heating of the receiving material 4 then has the effect that the hotmelt ink applied thereto can, to some extent, migrate thereinto.

The disadvantages accompanying this method of fixing are that the quantity of energy absorbed by the hotmelt ink cannot be metered sufficiently accurately and controllably so that unwanted flowing out and feathering may occur. An important factor in this case is that energy absorption with this method of heating the hotmelt ink is also determined by the properties of the receiving material 4 itself. The thermal capacity and thickness of the receiving material 4 are, for example, important parameters in this respect. Also, the receiving material 4 itself may distort. Variations in the value of these parameters also influence the degree of adhesion of the hotmelt ink.

FIG. 2 diagrammatically illustrates a number of different possible states of adhesion of a drop of hotmelt ink 3 to a receiving material 4. FIG. 2A shows the state which can occur immediately after the application of the hotmelt ink 3 by the printhead 1. In the absence of any heating of the receiving material 4, the drop of hotmelt ink 3 will not flow out further and will have poor adhesion to the receiving material 4.

Figure 2A:
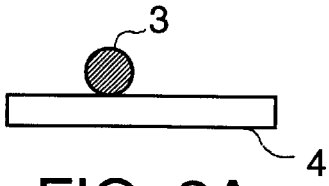
FIG. 2 shows different types of adhesion of ink to a receiving material.
Figure 2B:
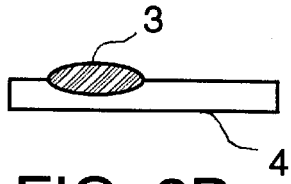

If the receiving material 4 is heated, or during a phase in which the drop of hotmelt ink 3 is still in the liquid state, it can flow out in the manner indicated in FIG. 2B and partially penetrate into the receiving material 4. A situation of this kind may be preferable with relatively hard inks because in this case a reasonable adhesion is obtained and there is still adequate optical surface coverage. In this connection the adhesion can only be said to be good if sufficient resistance is obtained to gumming, scratching and folding, i.e., the ink does not detach as a result of gumming, scratching and folding.

Figure 2C:
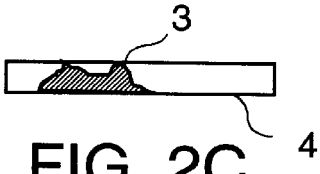

On the other hand, FIG. 2C illustrates a situation which may occur if the setting of the hotmelt ink 3 is too late. In this case the ink completely penetrates through the receiving material 4 and is visible at the back thereof. Also, in these conditions, the ink may have spread irregularly in the plane of the receiving material 4, for example along the paper fibers in the case where paper is used as the receiving material. This effect, which is not shown in detail in the drawing, results in a frayed edge, hence the term "feathering". This effect is important particularly in the case of fibrous receiving material. Also, the amount of ink 3 present at the upper surface of the receiving material 4 will be inadequate for good optical density.

Figure 2D:
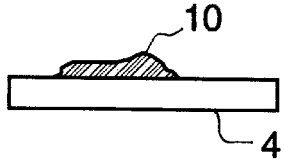

FIG. 2D illustrates the totally different situation which occurs in a resin-based toner powder 10 used in electrophotographic processes. On heating, such toner at most softens and is not liquid to the same extent as ink on a hotmelt basis. Such toner will accordingly not flow out and penetrate into the receiving material 4 to the same extent as is the case with hotmelt ink. In practice, with such toner, good adhesion must be effected by a combination of heating and the simultaneous application of pressure by pressure rollers.

Figure 2E:
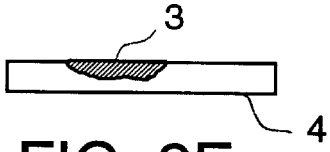

Finally, FIG. 2E shows a situation in which the ink 3 has penetrated completely in the receiving material 4 but in contrast to the situation shown in FIG. 2C is now just present at the upper surface of the receiving material and is not visible at its back.

Figure 3:
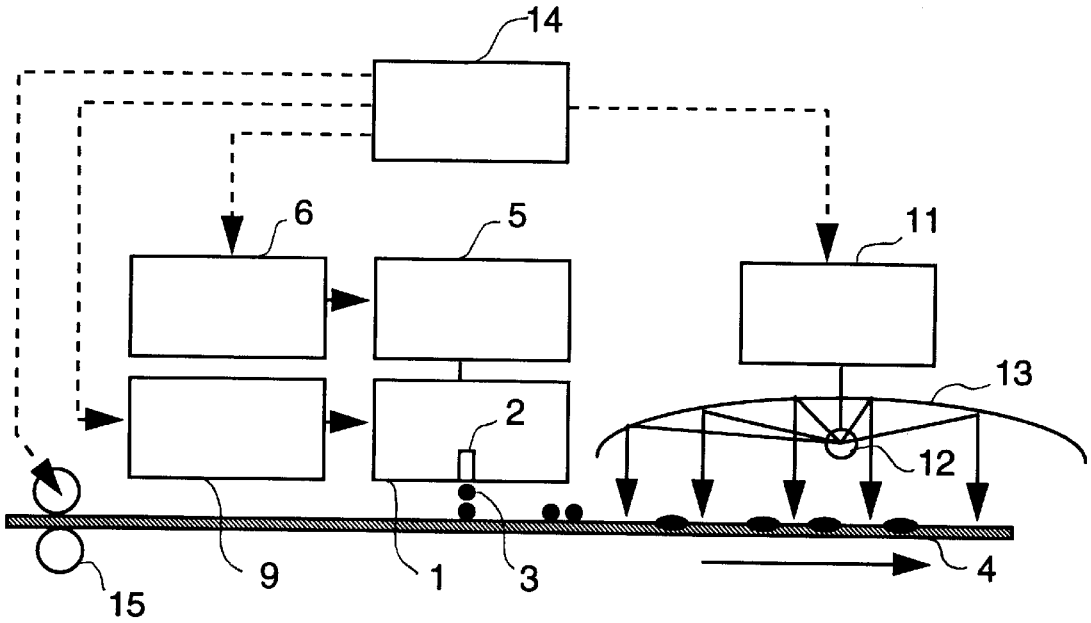
FIG. 3 diagrammatically illustrates one embodiment of an inkset printing device according to the present invention.

FIG. 3 shows an embodiment of an inkjet printing device according to the present invention. As in the embodiment shown in FIG. 1, the drawing shows a printhead 1 with a nozzle 2 for spraying hotmelt ink drops 3 on to receiving material 4, an ink supply chamber 5 in liquid communication with the printhead 1, first heating means 6 for keeping the hotmelt ink in a liquid state and an image generator 9 for generating electrical image signals for actuator means (not shown in detail) at an ink duct connected to the nozzle 3.

In contrast to the known inkjet printing device shown in FIG. 1, no heated guide plate is present for heating the receiving material 4. On the other hand, heating means 11, 12 and 13 are provided downstream in the transport path of the receiving material. They are constructed as radiant heating means in the form of a gas discharge lamp 12. The radiation emitted by the gas discharge lamp 12 falls, via a suitable reflector means 13, on to an image side of the receiving material 4. Commercially available gas discharge lamps can be used. A suitable gas discharge lamp is, for example, a Heiman flash lamp type HG 9903 GR 10B, having a tube diameter of 10 mm and an inter-electrode spacing of 313 mm. The pulse duration of this lamp is 400 $\mu$s. The gas discharge lamp 12 is controlled by lamp control means 11 which, in turn, is controlled by control means 14. The latter inter alia provides accurate synchronisation of the receiving material transport means 15, the first heating means 6 and the image generator 9 with the second heating means 11, 12 and 13. In these conditions, the total image formed on the receiving material 4 can be subjected to radiation in one operation in a single radiation pulse, or in parts with one radiation pulse per part.

Figure 5:
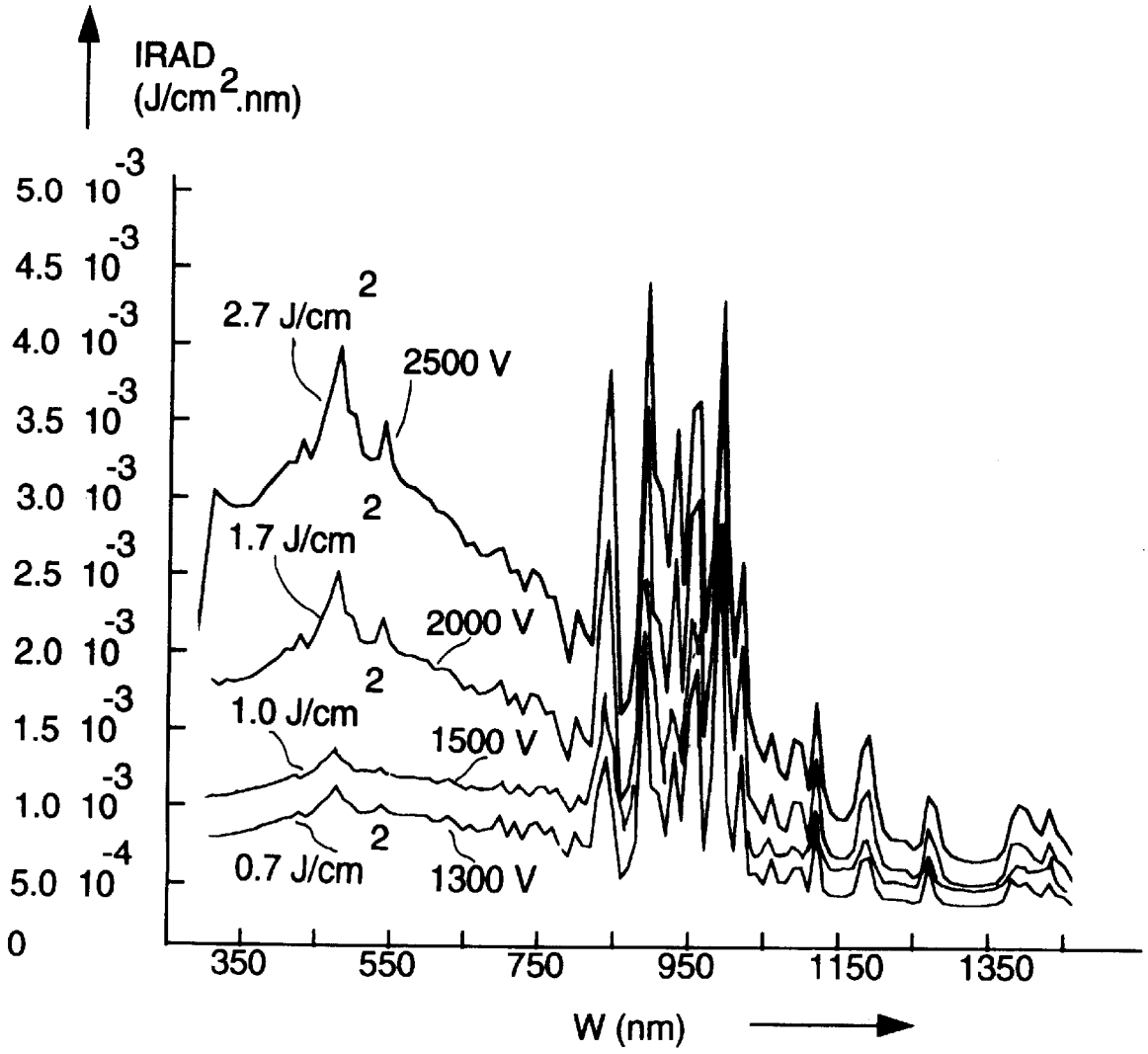
FIG. 5 shows the quantity of radiation (IRAD) of the receiving material versus the wavelength W for different operating voltages of a gas discharge lamp used in the second heating means.

FIG. 5 shows the spectral distribution of the gas discharge lamp 12. The quantity of energy IRAD falling on the receiving material is shown here versus the wavelength W. The drawing shows spectral distributions for various operating voltages applied over the gas discharge lamp, with, per line, the total quantity of radiation integrated over the entire wavelength range. In contrast to, for example, halogen radiating means, in which the emitted energy increases with the wavelength and in which the maximum energy yield occurs at wavelengths above 1000 nm, the maximum energy yield with the gas discharge lamp being used lies in the visible range with wavelengths of between 400 and 700 nm. A smaller proportion falls in the near infrared range with wavelengths of between 700 and 1700 nm. It will be seen from the drawing that the magnitude of the operating voltage not only determines this total quantity of energy but, via the resultant current density, also influences the spectral distribution. With an increasing operating voltage and hence current density, the yield in the visible range of from 400 to 700 nm increases more than the yield in the near infrared range of from 700 to 1700 nm. In practice, the operating voltage appears to be a good parameter not only for adjustment of the total quantity of emitted energy but also for adjustment of this spectral distribution. The absolute value of the applied operating voltage is, in these conditions, naturally dependent on the length of the gas discharge lamp used. An optimum choice for the operating voltage will be between a bottom limit at which adequate adhesion is obtained and a top limit where unwanted flowing out and feathering occurs. The current density is in this case the determining parameter for the spectral distribution.

In practice, with such spectral distributions, about 80% of the radiation appears to be reflected by paper. Also, the attainable temperatures in a drop of hotmelt ink are much higher than the temperature that the hotmelt ink has on leaving a nozzle of an inkjet head. As a result, the liquidity of the hotmelt ink is also higher. Thus for a typical hotmelt ink at the jet temperature of 125° C., the viscosity is 11 to 12 PaS. With irradiation in accordance with the invention, temperatures are briefly attainable at 150° C. with an associated viscosity of less than 10 PaS. This combination of very good liquidity over a very short time appears to give much better results than heating to lower temperatures over longer times.

A good working range is with a radiation yield of between 1 and 3 J/cm$^2$ integrated over the wavelength range from 400 to 1700 nm. Assessment for this can be effected optically, FIG. 4 showing diagrammatically the possible effects of different energy supplies.

Figures 4A, 4B, 4C:
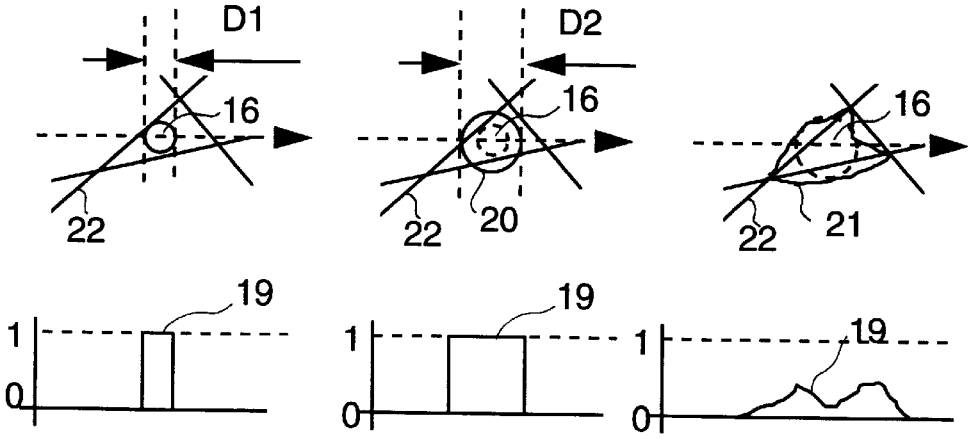
FIG. 4 shows different surface coverages of ink on receiving material.

In the top part of FIGS. 4A, 4B and 4C a drop of hotmelt ink 16 is illustrated as considered in the direction at right angles to the receiving material. FIG. 4A shows the situation before irradiation in which the drop 16 has a defined circular periphery with a diameter D1 corresponding to the drop diameter. FIG. 4B shows the situation after irradiation resulting in a larger surface coverage of the drop 16, again with a defined circular periphery 20 of diameter D2. FIG. 4C shows the situation after excess heating, resulting in an undefined periphery 21 of the drop 16. This undefined periphery 21 is partially caused by ink flowing out in accordance with the directions 22 of fibers in the receiving material as shown diagrammatically in the drawings.

The ratio of the diameter D2 of the circular drop after irradiation to the drop diameter D1 before irradiation is known as the spread factor S. In practice, this spread factor S is a good measure for determining a bottom limit for the minimum amount of irradiation required. This bottom limit is in fact determined by the gumming, scratching and folding resistance of the ink on the receiving material. In the case of relatively soft inks, adequate adhesion is obtained in accordance with these criteria if the ink has just completely penetrated into the receiving material as shown in FIG. 2E. With relatively harder inks good adhesion can already be achieved with a partial penetration as shown in FIG. 2B.

Thus, for example, in the case of such softer ink, with drop quantities of from 40 to 100 pl, corresponding to drop diameters of 40 to 60 $\mu$m, sufficient adhesion is obtained with a spread factor S of 2.5. In the case of relatively harder ink or with other drop quantities, this can however differ on the same receiving material.

A top limit for the quantity of irradiation will be determined by the time at which the ink will irregularly flow out over the receiving material, as shown in FIG. 4C. In this case, the drop diameter in relation to the dimensions of the fiber structures present in the receiving material will also play a part.

Also, in FIGS. 4A, 4B and 4C, in the bottom diagrams, the corresponding optical density is given on the vertical axis as a function of the position on the receiving material on the horizontal axis. The sequence of these positions is determined in accordance with the direction indicated by an arrow in the above Figures. In FIG. 4A, the area corresponding to 16 on the receiving material is covered by a quantity of hotmelt ink still lying on the receiving material, resulting in a level 19 for the optical density. The maximum optical density in this case is standardised at 1 and the minimum optical density at 0.

FIG. 4B shows the ideal situation in which after irradiation the flowing out of hotmelt ink over a larger part of the receiving material corresponding to the area 20 is such that the level 19 is still attained for the optical density but the adhesion to the receiving material is greatly improved.

FIG. 4C, on the other hand, shows the situation after excessive flowing out of the hotmelt ink over the receiving material, resulting in a non-defined form 21. Apart from the fact that this results in reduced sharpness due to the large area 21 over which the hotmelt is spread, the above-mentioned feathering also appears to occur here. This is shown diagrammatically here by the flowing out of the ink along the fiber directions 22. As illustrated, in this case a lower level is also obtained for the optical density 19 since some of the ink is no longer visible on the upper surface of the receiving material.

Figure 6:
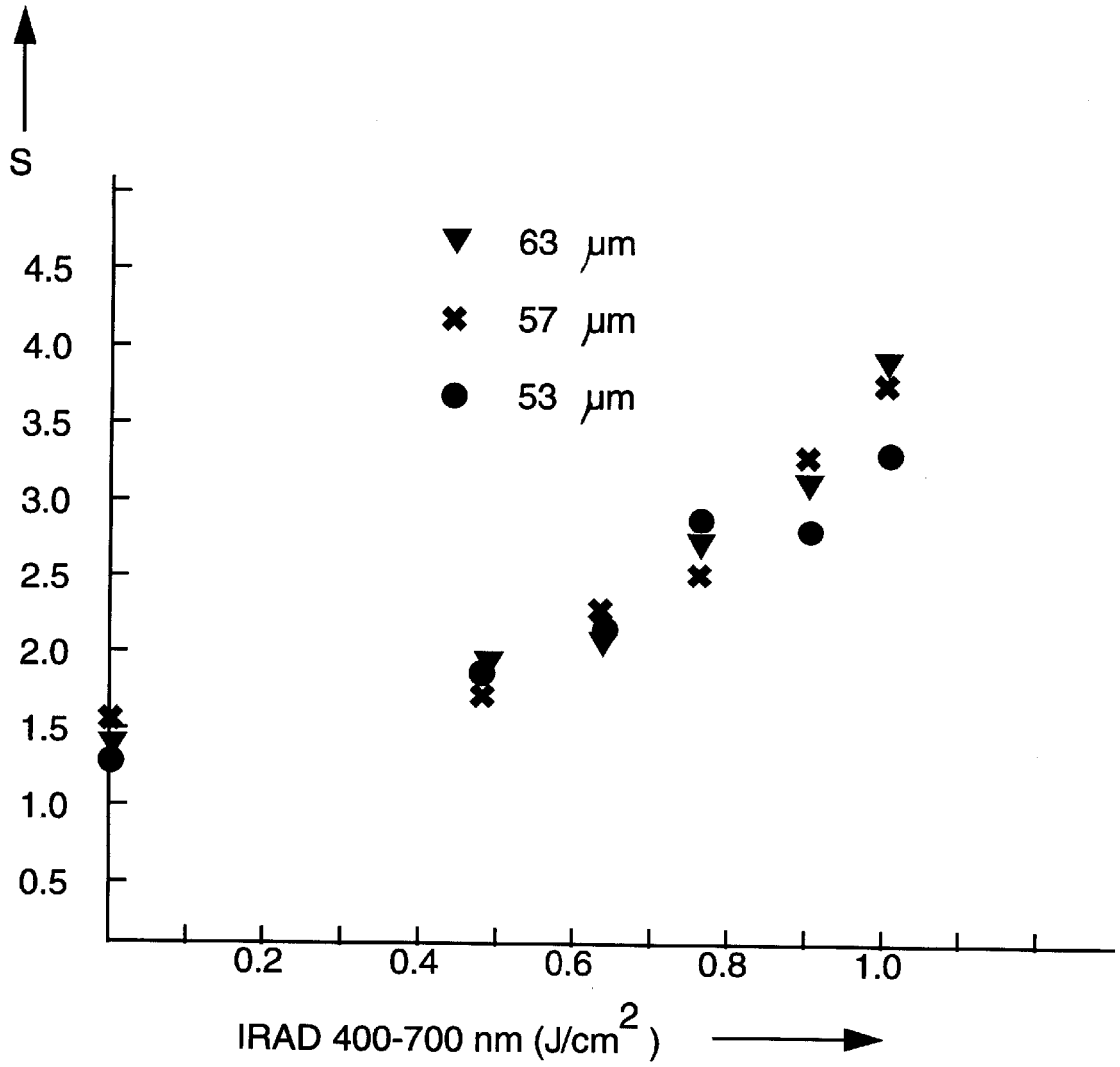
FIG. 6 shows the measured spread factors S versus the total quantity of received radiation (IRAD) integrated over the 400 to 700 nm wavelength range for different ink drop sizes.

FIG. 6 shows the above-mentioned spread factor S against the quantity of radiation energy IRAD falling on the receiving material, such quantity being integrated over the wavelength range from 400 to 700 nm. The spread factors S have been measured here for three different drop sizes of the hotmelt ink. In practice, a good working range is found to be obtained in the energy range from 0.25 to 2 J/cm$^2$ integrated over the wavelength range from 400 to 700 nm.

If different colors of hotmelt inks are used, e.g. cyan, magenta and yellow, differences in mutual energy absorption by these inks may occur so that a different flowing out of the ink occurs. This is inherent in the irradiation of these inks with visible light, the color of the hotmelt ink determining the part of the energy spectrum absorbed by the ink. This difference is most pronounced with black ink, which absorbs energy over the entire visible wavelength range, compared with colored hotmelt ink which absorbs energy only over part of the visible wavelength range. To compensate for these differences in energy absorption, according to the present invention, substances which absorb energy in the infrared wavelength range are additionally added according to the invention. Due to their absorption outside the visible wavelength range, these substances have no influence on the colorr of the hotmelt inks. Preferably, the quantity of such substance added per colored hotmelt ink is such that an equal degree of total energy absorption occurs for all the colors of the hotmelt inks when used in the inkjet printing device according to the present invention. In this connection it should be noted that even if a hotmelt ink is used in just one single color, such substances can also be added in order to obtain improved fluid behaviur on irradiation in accordance with the inkjet printing device described. In these conditions the spectral distribution of the gas discharge lamp plays an important part.

Suitable infrared-absorbent substances are described, for example, in U.S. Pat. Nos. 4,539,284 and 5,432,035. The applications described therein are limited to resin-based toner intended for use in an electrophotographic process.

It should also be noted that the facilities for irradiation of the hotmelt ink need not necessarily be contained in the inkjet printing device. The irradiation means described can equally be disposed separately from the inkjet printing device. The irradiation to be carried out therewith can, if required, be effected even a longer time after the application of the hotmelt ink.

Also, if required, one and the same area or parts of one and the same area can be irradiated several times, for example in order to average out inequalities in an irradiation profile.

Finally, FIG. 7 gives some examples illustrating the various graduations of the flowing out of a pattern formed by loose drops of hotmelt ink on paper as a receiving material. FIG. 7A shows the hotmelt ink drops sprayed on the paper without either the paper or the ink having been heated. This example corresponds to the situation shown diagrammatically in FIG. 4A. In FIG. 7A, small dark and sharply defined cores (area 16 in FIG. 4A) can be distinguished with a diameter of about 70 $\mu$m. The adhesion to the receiving material is in this case inadequate, the hotmelt ink not yet having penetrated sufficiently into the paper.

Figure 7A:
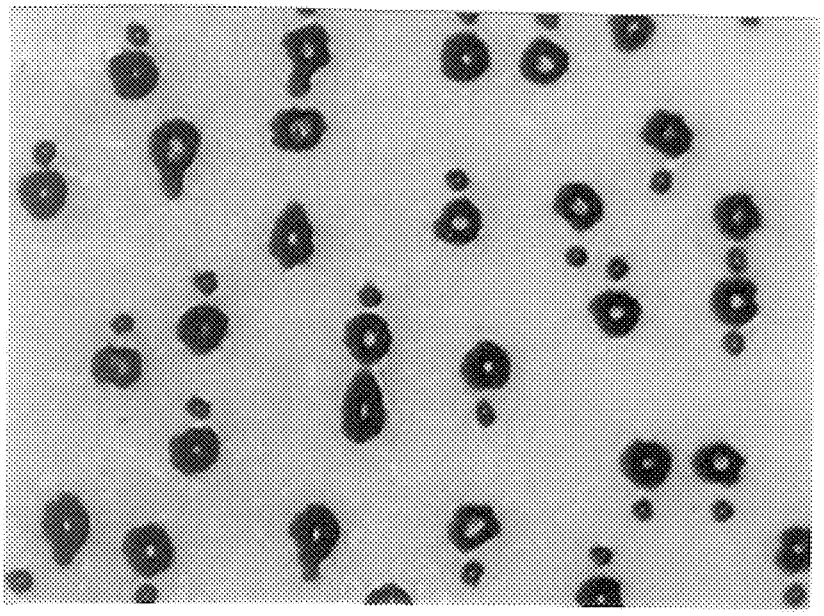
FIGS. 7A, 7B, 7C and 7D show examples of separate hotmelt ink drops on receiving material.
Figure 7B:
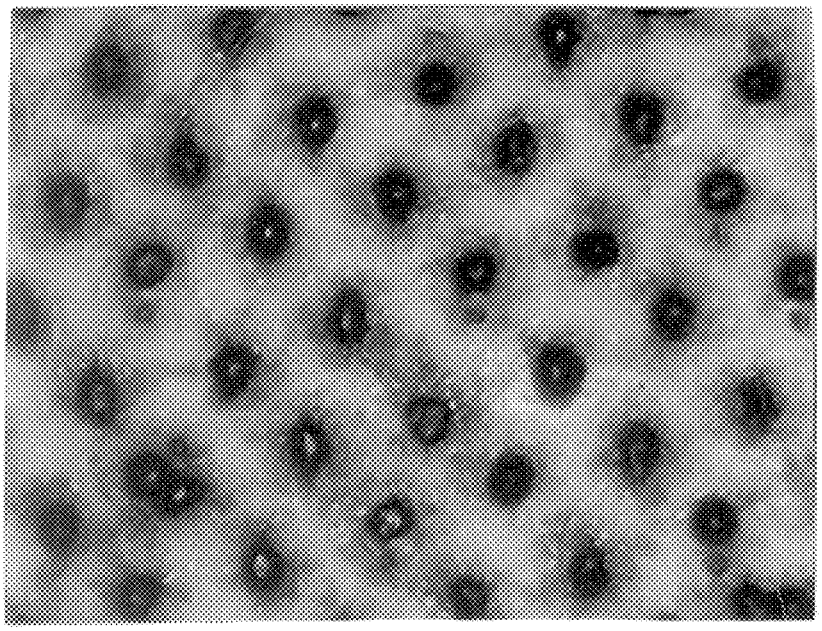

FIG. 7B shows the situation as obtained after conventional heating for some time in an oven with a temperature close to the melting temperature of the hotmelt ink. Here again, sharply defined dark cores can be distinguished, but now also a start of the hotmelt ink flowing out into the paper. This flowing out is, however, characterized by an inadequate optical density and appears to give a still inadequate adhesion.

Figure 7C:
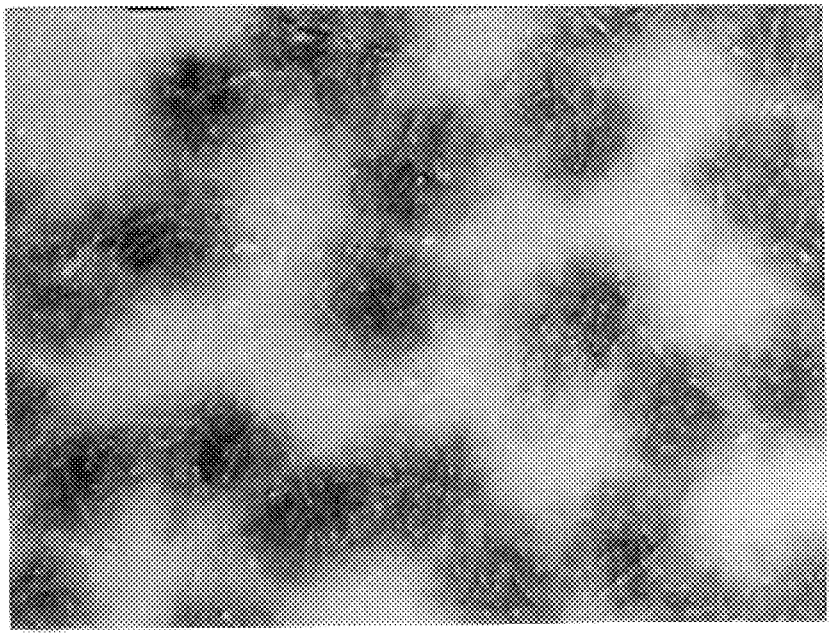

FIG. 7C shows the situation after still longer heating in an oven with temperatures above the melting temperature of the hotmelt ink. The corresponding situation is shown diagrammatically in FIG. 4C. Here the hotmelt ink has migrated into the paper to an extent such that the optical density is inadequate. An irregular pattern of the flowing out of the hotmelt ink is also now perceptible, i.e. "feathering".

Figure 7D:
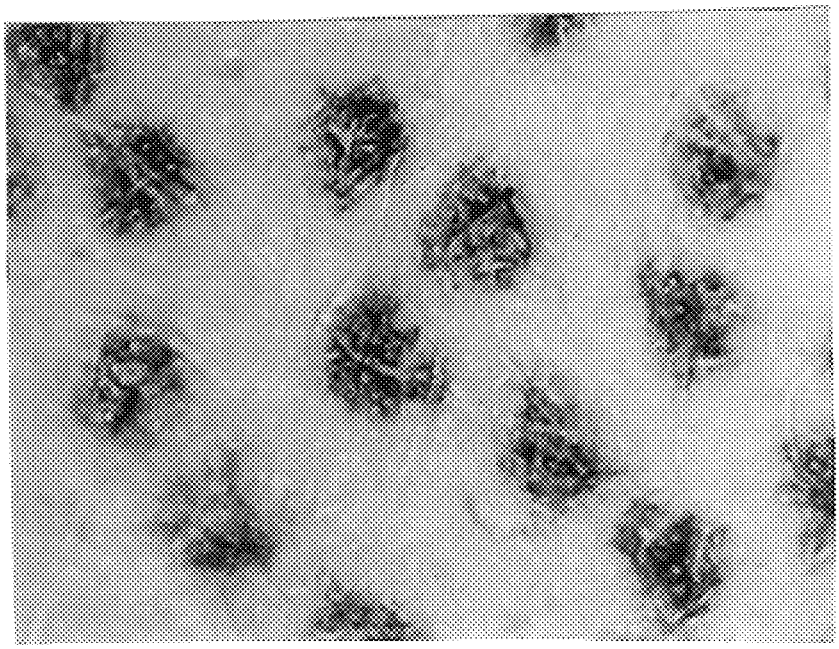

FIG. 7D shows the situation after heating according to the present invention. The corresponding situation is shown diagrammatically in FIG. 4B. Here, a larger but still dark and sharply defined core is formed with a diameter of about 210 $\mu$m (area 20 in FIG. 4B). The adhesion to the receiving material and the optical density is in this case adequate.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A combination of hotmelt inks which contains at least two hotmelt inks for two different colors selected from the group of colors formed by C, M, Y or K, said hotmelt inks containing an infrared-absorbent substance which is active primarily in a wavelength range of from 700–1700 nm and being suitable for use in an inkjet printing device, wherein the quantity of infrared-absorbent substance of the first hotmelt ink for at least one first color differs from the quantity of infrared-absorbent substance of the second hotmelt ink for at least a second color, in such a manner that after a simultaneous heating of both the first and second hotmelt inks applied image-wise to a receiving material, by means of the same radiation energy and for the same period of time, the at least first and second hotmelt inks penetrate equally at least partially into the receiving material without visible feathering occurring.

* * * * *